US008550310B2

(12) United States Patent
Alstad et al.

(10) Patent No.: US 8,550,310 B2
(45) Date of Patent: Oct. 8, 2013

(54) PERISTALTIC PUMP

(75) Inventors: Knute Alstad, Sun Prairee, WI (US); Todd James Bakken, Madison, WI (US); Jesse Charles Darley, Madison, WI (US); Jeffery W. Kadyk, Sherman, IL (US); Jason Ray Lieving, Mount Pulaski, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 247 days.

(21) Appl. No.: 12/746,453

(22) PCT Filed: Dec. 5, 2008

(86) PCT No.: PCT/US2008/013420

§ 371 (c)(1),
(2), (4) Date: Aug. 9, 2010

(87) PCT Pub. No.: WO2009/073212

PCT Pub. Date: Jun. 11, 2009

(65) Prior Publication Data

US 2010/0301071 A1 Dec. 2, 2010

Related U.S. Application Data

(60) Provisional application No. 60/992,551, filed on Dec. 5, 2007.

(51) Int. Cl.
*B65D 37/00* (2006.01)

(52) U.S. Cl.
USPC ..... 222/214; 417/477.11

(58) Field of Classification Search
USPC ..... 222/214, 129.1, 213, 129.2–129.4; 417/477.11, 53, 474–478
See application file for complete search history.

(56) References Cited

U.S. PATENT DOCUMENTS

| | | | | |
|---|---|---|---|---|
| 2,035,159 | A * | 3/1936 | Henry | 417/476 |
| 3,011,684 | A | 12/1961 | Corneil | |
| 3,249,059 | A * | 5/1966 | Renn | 417/477.6 |
| 3,358,609 | A | 12/1967 | Parmer et al. | |
| 3,447,478 | A | 6/1969 | Clemens | |
| 3,597,124 | A | 8/1971 | Adams | |
| 3,836,287 | A | 9/1974 | Grosholz et al. | |
| 3,876,340 | A | 4/1975 | Thomas et al. | |

(Continued)

FOREIGN PATENT DOCUMENTS

| | | |
|---|---|---|
| EP | 0248653 | 12/1987 |
| FR | 2598182 | 11/1987 |

(Continued)

OTHER PUBLICATIONS

Search Report and Written Opinion issued in International Application No. PCT/US08/13420 (2009).

*Primary Examiner* — Lien Ngo
(74) *Attorney, Agent, or Firm* — Barnes & Thornburg LLP

(57) ABSTRACT

A peristaltic pump assembly and system that facilitates reliable and efficient engagement and removal of a flexible tube. A stator is pivotally retained on a structure and cooperatively operated by a lever arm and cam to engage and disengage the stator from the tube and a corresponding rotor. The stator pivots at a point distal from a point of rotation of the rotor and the lever arm moves about a fixed rotation axis to engage and disengage the stator with the tube relative to the rotor.

21 Claims, 10 Drawing Sheets

(56) References Cited

U.S. PATENT DOCUMENTS

| | | | | | |
|---|---|---|---|---|---|
| 3,963,023 | A | | 6/1976 | Hankinson | |
| 3,990,444 | A | | 11/1976 | Vial | |
| 4,025,241 | A | | 5/1977 | Clemens | |
| 4,179,249 | A | | 12/1979 | Guttmann | |
| 4,211,519 | A | | 7/1980 | Hogan | |
| 4,231,725 | A | | 11/1980 | Hogan | |
| 4,256,442 | A | * | 3/1981 | Lamadrid et al. | 417/477.11 |
| 4,315,718 | A | | 2/1982 | Hogan | |
| 4,487,604 | A | | 12/1984 | Iwatschenko | |
| 4,519,754 | A | | 5/1985 | Minick | |
| 4,552,516 | A | | 11/1985 | Stanley | |
| 4,606,710 | A | | 8/1986 | Maguire | |
| 4,673,334 | A | | 6/1987 | Allington | |
| 4,717,047 | A | | 1/1988 | van Overbruggen et al. | |
| 4,798,580 | A | | 1/1989 | DeMeo et al. | |
| 4,886,431 | A | | 12/1989 | Soderquist | |
| 4,925,376 | A | | 5/1990 | Kahler | |
| 4,976,590 | A | * | 12/1990 | Baldwin | 417/53 |
| 5,082,429 | A | | 1/1992 | Soderquist et al. | |
| 5,096,393 | A | | 3/1992 | Van Steenderen | |
| 5,230,614 | A | | 7/1993 | Zanger et al. | |
| 5,256,041 | A | * | 10/1993 | Tucker | 417/477.9 |
| 5,257,917 | A | | 11/1993 | Minarik | |
| 5,380,173 | A | | 1/1995 | Hellstrom | |
| 5,388,972 | A | * | 2/1995 | Calhoun et al. | 417/477.11 |
| 5,413,252 | A | | 5/1995 | Magnus | |
| 5,433,588 | A | * | 7/1995 | Monk et al. | 417/477.2 |
| 5,447,417 | A | | 9/1995 | Kuhl | |
| 5,558,507 | A | | 9/1996 | Magnus | |
| 5,846,061 | A | | 12/1998 | Ledebuhr | |
| 5,875,930 | A | * | 3/1999 | Nakajima et al. | 222/129.1 |
| 6,019,582 | A | | 2/2000 | Green | |
| 6,041,709 | A | | 3/2000 | Wells | |
| 6,120,263 | A | | 9/2000 | Kosters | |
| 6,142,340 | A | * | 11/2000 | Watanabe et al. | 222/66 |
| 6,149,621 | A | | 11/2000 | Makihara | |
| 6,164,921 | A | * | 12/2000 | Moubayed et al. | 417/44.1 |
| 6,186,752 | B1 | | 2/2001 | Deniega et al. | |
| 6,293,758 | B1 | | 9/2001 | Green | |
| 6,419,466 | B1 | | 7/2002 | Lowe et al. | |
| 6,494,692 | B1 | | 12/2002 | Green | |
| 7,223,079 | B2 | | 5/2007 | Ortega | |
| 7,287,968 | B2 | | 10/2007 | Haser | |
| 7,467,932 | B2 | | 12/2008 | Schann et al. | |
| 7,478,999 | B2 | | 1/2009 | Limoges | |
| 7,713,036 | B2 | | 5/2010 | Kojima et al. | |
| 7,722,338 | B2 | * | 5/2010 | Nordell et al. | 417/477.11 |
| 8,052,399 | B2 | * | 11/2011 | Stemple et al. | 417/53 |
| 8,128,384 | B2 | * | 3/2012 | Mou | 417/477.11 |
| 2005/0254978 | A1 | | 11/2005 | Huber et al. | |
| 2006/0177328 | A1 | | 8/2006 | Nordell et al. | |

FOREIGN PATENT DOCUMENTS

| | | |
|---|---|---|
| GB | 2051253 | 11/1983 |
| GB | 2240664 | 8/1991 |
| GB | 2242073 | 9/1991 |

* cited by examiner

PERISTALTIC PUMP

CROSS REFERENCE

This patent application is a U.S. nationalization under 35 USC § 371 of International Application No. PCT/US2008/013420, filed May 12, 2008, which claims the benefit of priority under 35 U.S.C. § 119(e) to U.S. Provisional Application Ser. No. 60/992,551, filed Dec. 5, 2007. The disclosures set forth in the referenced applications are incorporated herein by reference in their entireties, including all information as originally submitted to the United States Patent and Trademark Office.

BACKGROUND

This disclosure provides apparatus and methods relating to peristaltic pumps and more particularly to pumps, which includes a releasable occlusion bed or stator.

Equipment for controllably dispensing beverage materials, fluids or components are generally well known in the prior art. A variety of general forms of equipment have been developed for dispensing liquid flavor ingredients for mixing with a dilution material. For example, in the juice dispensing industry, machines have been developed that can be controllably operated by a user to dispense a desired quantity of a juice beverage. Such equipment might be used in a food service setting, including, but not limited to, a cafeteria, kitchen or other setting in which a user can simply and easily operate a control such as a push button to dispense a quantity of beverage.

Such a machine could use a beverage concentrate which is mixed with water to reconstitute a desired beverage. Use of a concentrate allows a machine to dispense an increased volume of resultant beverage in relation to the volume of material or concentrate used in the system. In other words, a beverage concentrate can be placed in the machine and controllably dispensed. The beverage concentrate can be dispensed for mixing with water or some other dilution material to produce a desired reconstituted beverage. Additionally, the ratio of concentrate to dilution material can be adjusted for profitability, personal preferences or other mixing criteria.

In order to properly control the dispensing of the resultant beverage, a pump or other driving device must be used to move concentrate from a storage container to the resultant beverage container or a mixing stream for mixing with a dilution material. Prior art equipment have used peristaltic pumps to provide the motive force to draw or otherwise move concentrate from a concentrate container to the dilution stream.

A peristaltic pump includes a controllable rotary device, an occlusion bed or stator, and a flexible tube retained in a controllably compressible condition between the rotary device and the stator. The peristaltic pump operates on a peristaltic action in which rollers on the rotary device or rotary sequentially pinch or squeeze the flexible tube against the stator. In this regard, controllable, relatively small volumes of concentrate can be moved from the concentrate container. Controllably powering the motor coupled to the rotor causes the pump to pump concentrate from the container. Controllably deenergizing the motor connected to the rotor stops the pumping action. Stopping the pumping action operates as a valve to prevent further drainage, dripping or pumping of concentrate from the container.

By controlling the pump speed for a predetermined tube size and compressibility characteristics, a desired volume of concentrate can be dispensed over a specified period of time.

Dispensing typically delivers the concentrate to a dilution flow path such as water being dispensed for mixing with the concentrate. The two paths can be brought together in a nozzle to produce a consistent output or resultant beverage. Alternatively, the two paths can be brought together in an output stream and mixed in a container receiving the two products.

Regardless of the details associated with the flexible tube, mixing paths and nozzles, improvements have been made in the pump apparatus and the interaction of the pump with the flexible tube. The present disclosure provides information relating to improvements in the structure and function of a peristaltic pump.

BRIEF DESCRIPTION OF THE DRAWINGS

The present disclosure will be described hereafter with reference to the attached drawings which are given as non-limiting example only, in which.

Figure 1:
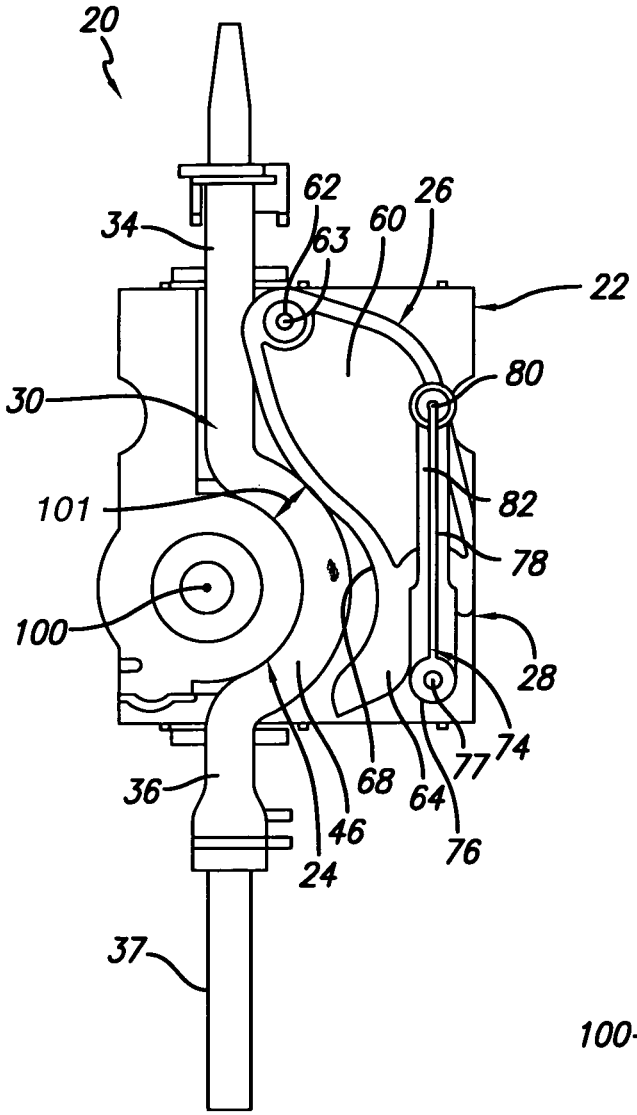
FIG. 1 is a view of a peristaltic pump assembly of the present disclosure showing a rotary device or rotor, a movable occlusion bed or stator, a lever arm, and flexible tube, arranged in an orientation in which the stator is disengaged from retaining the tube against the rotor with a tube being installed between the rotor and the stator.

The exemplification set out herein illustrates embodiments of the disclosure and are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure and is not intended to be exhaustive or to limit the disclosure to the details of construction and the arrangements of components set forth in the following description or illustrated in the drawings.

With referenced to FIG. 1, a pump assembly 20 is shown which includes a base 22, a rotary device or rotor 24, a movable occlusion bed or stator 26, a lever arm or handle 28 and a flexible pumping tube 30. A controllable motor 32 of known construction and operation (FIGS. 4 and 7) is operatively coupled to the rotor 24 to controllably operate rotation of the rotor and provide a motive force for inducing the peristaltic pumping action in the system. A controller (not shown) is coupled to the motor to controllably operate rotation of the rotor by controlling operation of the motor 32.

The tube 30 includes an input end 34 and an output end 36. The input end 34 attaches to a material container such as a bag-in-box or other container for retaining a beverage concentrate. Any form of coupling may be provided at the input end 34 which facilitates desired characteristics for connecting the tube 30 to the concentrate or other container. It is envisioned that this tube could connect to another tube which connects to a remote container such as a remote bag-in-box container or may be adapted to connect to a container which is positioned in a cabinet which contains the pumps as well as the container.

The output end 36 may be connected to a nozzle 37 or other structure which can provide mixing or combining action of the concentrate with additional ingredients such as a dilution material. For example, in a concentrate juice dispensing device, concentrate enters the input end 34, travel through the tube 30 under the motive action of the pump assembly 20 and exits the output end 36 for mixing with water delivered to the nozzle 37 through a corresponding water line 39 (see FIGS. 4, 8-10) to provide a resultant beverage. The nozzle 37 or dispensing end could be any form structure which might include active or passive mixing. Alternatively, the mixing could occur upstream of the pump apparatus 22 with the peristaltic action provided by the rotor 24 and stator 26 on the tube 30 providing further mechanical mixing as the combined mixture flows through the tube 30 for dispensing.

Regardless of the input end 34 and the output end 36 connectors, nozzles, mixing apparatus or other structures, the pump assembly 20 generally provides action on a pumping portion 46 of the tube 30 operatively retained generally between corresponding portions of the rotor 24 and the stator 26. The rotor **24*a* includes multiple rollers 48 (see FIGS. 6, 7, 9, 10). Pairs of rollers 48 act on the tube 46 squeezing, pinching or otherwise at least partially occluding a corresponding portion 50 of the pumping portion 46 of the tube. A motive volume 52 is defined in the space or pocket within the tube between the neighboring rollers 48. As the rotor 24 rotates, neighboring pairs of rollers 48** advance along the tube rolling, occluding, and moving a portion of material through the tube at the motive volume. This peristaltic action provides relatively definable volumes of material which can be pumped depending on the rate of pumping, spacing of rollers, size of tube, degree of occlusion, viscosity of the material, as well as other factors and characteristics.

Figure 6:
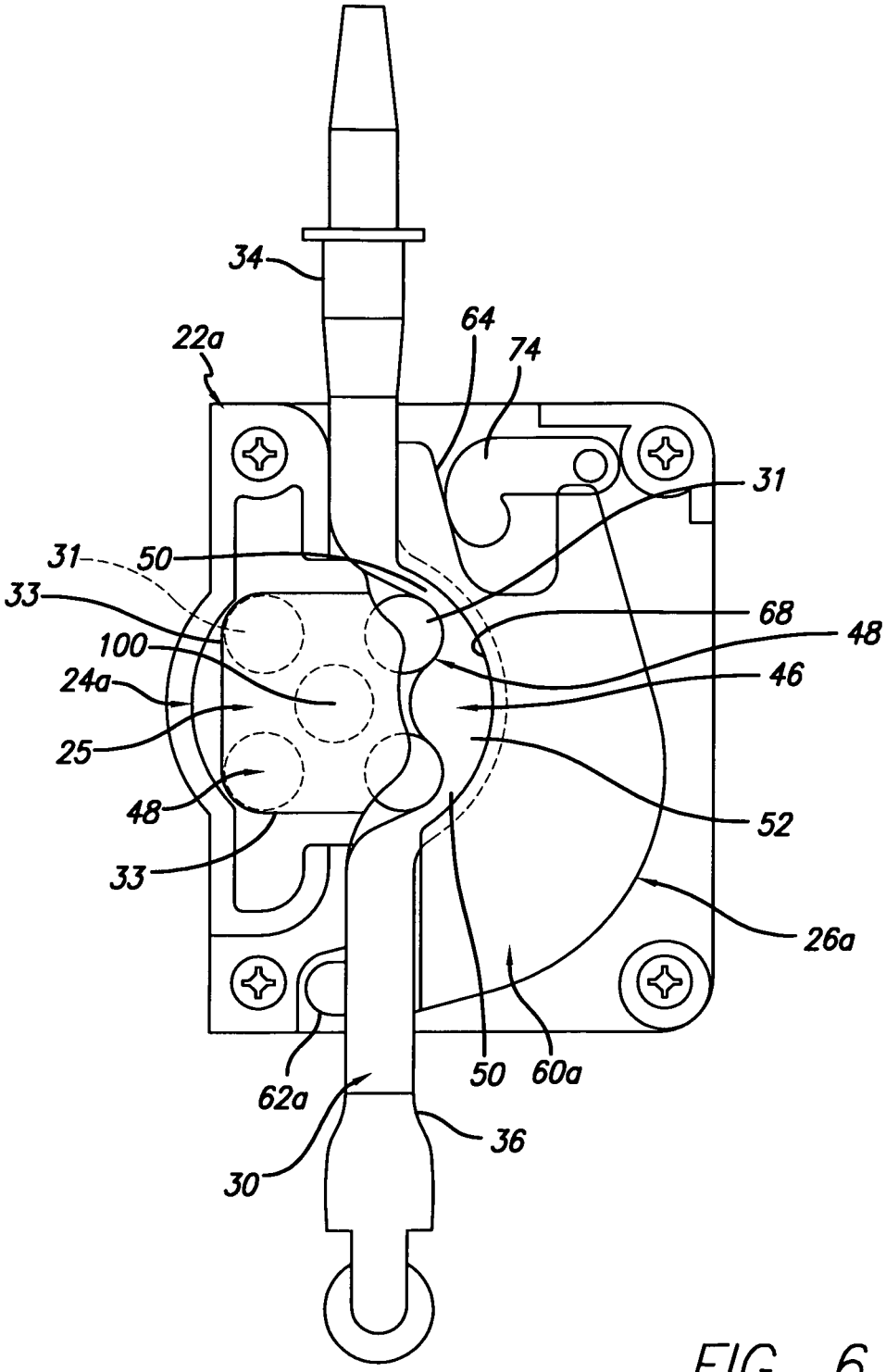
FIG. 6 is a second view of the pump as shown in FIGS. 4 and 5, in which the rotor is shown in partial fragmentary view, with the stator moved by cam action of the handle so that the stator acts to retain a pumping portion of the tube in engagement with the rotor and in which rollers of the rotor at least partially occlude or pinch the tube.
Figure 7:
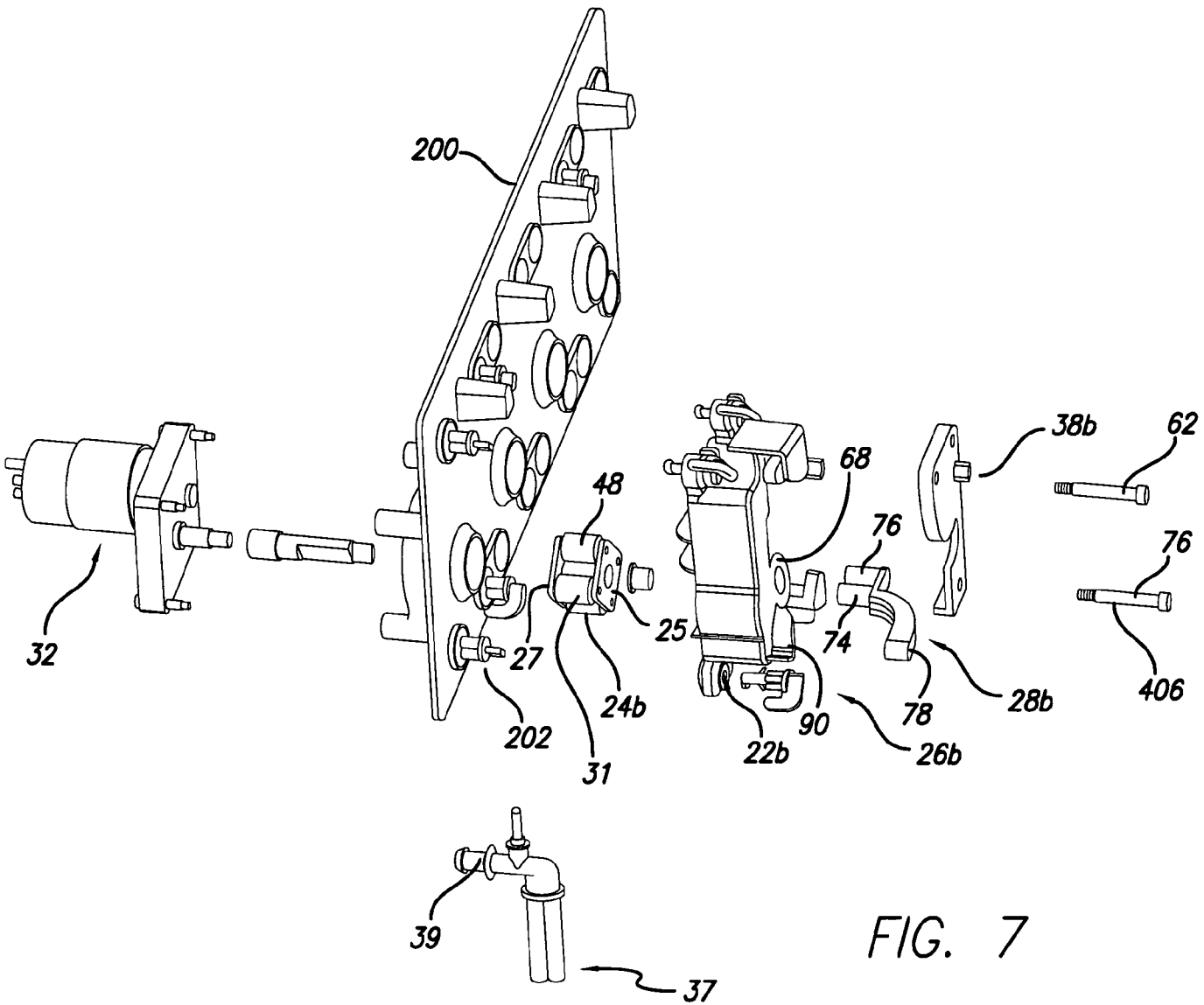
FIG. 7 is an exploded perspective view of a pump assembly, mounting wall, and controllable motor connectable to the pump through the wall, which, when assembled, the wall is retained in a beverage dispensing cabinet with the pump assembly being retained in a cooled portion of the cabinet for maintaining freshness of product retained in the tube of the pump, and the motor generally being retained on an uncooled side of the wall.

With reference to FIGS. 6 and 7, the rotor **24*a* includes a pair of rotor plates 25, 27. The rotor plates are generally sufficiently large to cover the ends 31 of the corresponding rollers 48. Generally, as shown the rotor plates 25, 27, are non-circular. In the configuration as shown, including four rollers 48, the roller plates approximate a square-shape. Generally, there is no additional material extending beyond the tangent points 33 of the rollers 48. This configuration of the roller plates helps to prevent pinching or binding of the tube. Preventing pinching or binding of the tube helps reduce wear and possible damage to the tube. Additionally, this non-circular shape of the plates 25, 27** helps to encourage engagement or realignment of the tube between the rollers and the stator should the tube not be properly aligned during the initial installation.

In use, the tube is placed between the stator **26*a* and the rotor 24*a*. Once the tube is retained between the stator and the rotor portions of the rollers 48 pinch the tube 30 against the stator. The absence of material on the rotor plates 25, 27 extending beyond the generally tangential points 33 of the rollers. 41 prevent pinching of the tube 30 between the plate and the stator and therefore enhance the useful life of the tube. The absence of the extending material on the plates also encourages the tube 30 to maintain alignment between the input end 34 and the output end 36**.

The reference to a juice or other specific concentration herein is used as an illustration and not a limitation. The present pump assembly should be interpreted as being applicable to the pumping of any type of material that might be pumped using a peristaltic pump assembly 20 as disclosed. Additionally, the pumping of materials is not limited to the food or beverage industry but is intended to be broadly applicable to any industry in which the present assembly might find utility. Terms including beverage, concentrate, material, brewed, and brewing as may be used herein are intended to be broadly defined as including, but not limited to the making of juice, tea, coffee and any other beverages or food substances that will benefit from the present disclosure. This broad interpretation is also intended to include, but is not limited to, any process of dispensing, mixing, reconstituting, infusing, steeping, diluting, dissolving, saturating or passing a liquid through or otherwise combining a beverage substance with a liquid such as water without limitation to the temperature of such liquid unless specified. This broad interpretation is also intended to include, but is not limited to beverage substances such as coffee, tea, liquid beverage concentrate, powdered beverage concentrate, flaked, granular, freeze-dried or other forms of materials including liquid, gel, crystal or other form of beverage or food materials currently in existence or to be developed to obtain a desired beverage or food product.

Figure 2:
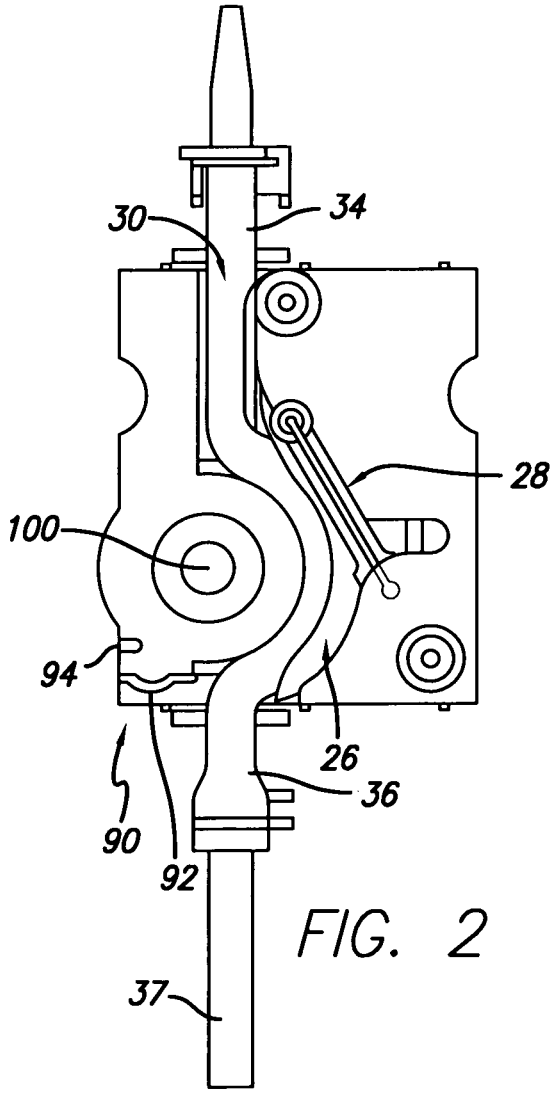
FIG. 2 is a progressive view compared to FIG. 1 in which the stator is advanced towards the rotor for retaining a pumping portion of the tube between the stator and rotor, during this progression the lever arm is moved to provide to operate or cam structure to provide a cam action to move the stator into engagement with the tube.
Figure 3:
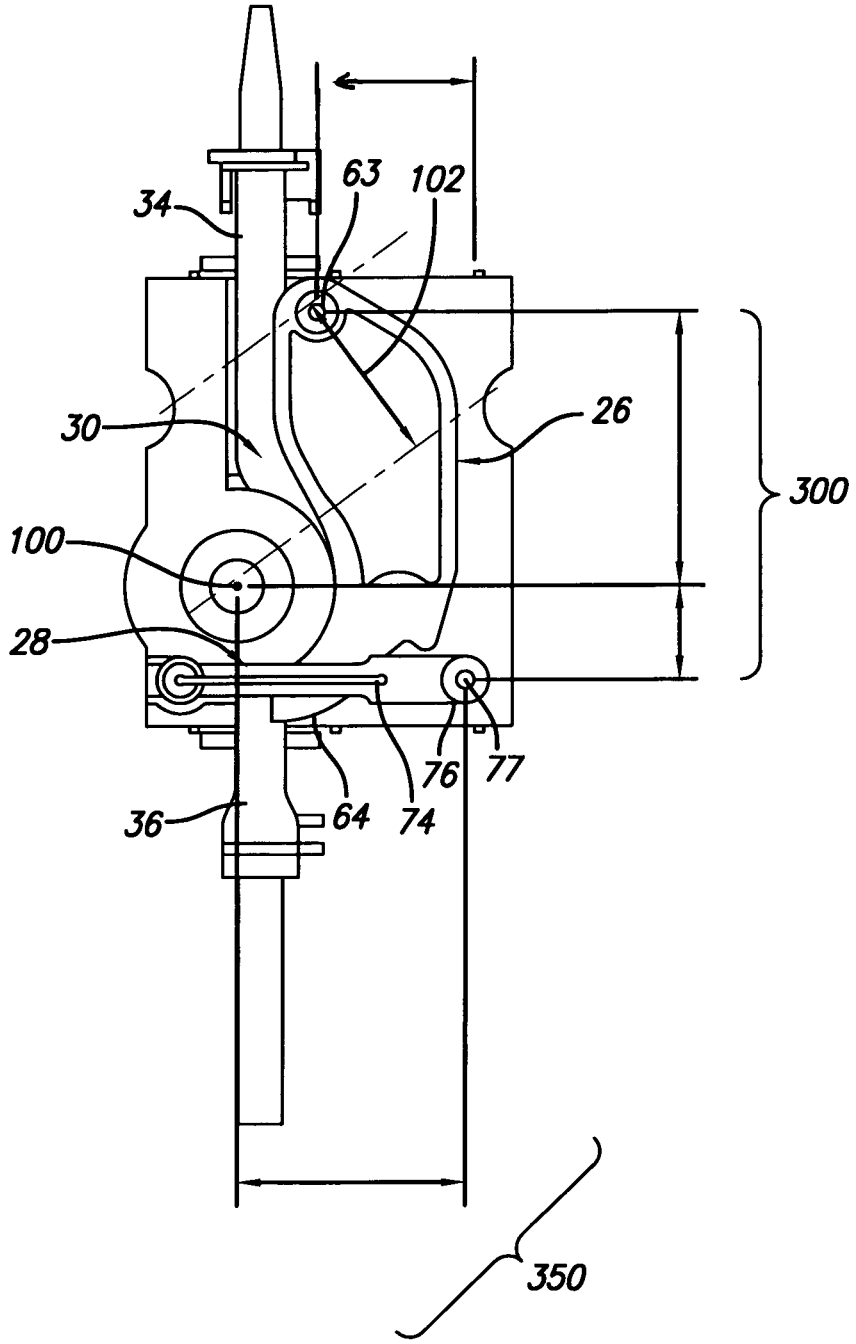
FIG. 3 is a third progression of the pump assembly as shown FIGS. 1 and 2 in which the stator has been advanced into position to retain the pumping portion of the tube against the rotor with the lever arm in a downward most position retaining the stator in engagement with the tube against the rotor and a portion of the lever arm being retained in a detent position to provide a retaining, lever arm advanced function.

With reference to FIGS. 1-3, the structure of stator 26 includes a body portion 60, a pivot hub 62 defining a pivot point 63 positioned at one end of the body 60 and a cam assembly 64 positioned generally spaced from or otherwise distal from the pivot hub 62. The structure positioned between the pivot point 63 and the cam assembly 64 is a stator surface or face 68 positioned generally in opposition to the rotor 24. The face 68 is generally formed with a generally flat surface 70 across the narrow dimension of the stator generally corresponding to an outside surface or arc traced by the rollers on the rotor. The face 68 is sized and dimensioned to accommodate tubes having a range of outside diameters. The face 68 is formed extending between or generally proximate to the pivot hub 62 and an area at least proximate to the cam structure 64 generally including a curve along the long dimension of the stator which is formed to cooperatively engage at least a pumping portion 46 of the tube 30 against the rotor 24.

The lever arm 28 includes a cam driver 74 generally positioned extending from a pivot end 76 of the handle. The pivot end 76 is retained on the body 22. A lever portion 78 of the handle extends away from the pivot 76 towards a distal end 80. The lever portion 78 includes a bridge 82 which extends over an engaged portion of the tube with the tube retained between the rotor and the stator. The distal end 80 of the handle 28 is size and dimensioned for engaging a detent or locking structure 90 on the body. In this regard, the distal end 80 includes a protrusion which engages a retaining stop 92 and a detent 94. When the handle is rotated into position to operate the cam structure 74 against the cam surface 64 of the stator 26, the end 80 is positioned to stop against the stop 92. Once the end 80 has contacted the stop the detent 94 retains the position. The handle can be disengaged from the detent structure 90 by application of force to overcome the retaining force of the detent 94.

The lever arm is shown as a handle or lever device. It is envisioned that a variety of operating structures such as knobs, wheels, or other devices may be used to provide the same or similar mechanical advantage provided by the arm. As such, the present disclosure is not limited to an arm but is intended also to include any variety of structures which might operate the stator relative to the rotor and the configuration as provided herein.

The orientation of the body 60 movably attached to the pump body 22 at the pivot point 62 helps facilitate engagement of the tube between the structures. In this regard, the body 60 does not need to work against gravity as it is retained from the pivot point 62. The natural tendency of this structure and the orientation of the body is to fall, lie or move against the tube. In this regard, the handle 28 can be used to retain the stator 26 out of engagement with the tube. Likewise, the cam structure 74 on the handle engaging a corresponding cam surface 64 on the stator 26 generally provides some degree of over center engagement even if the end 80 is not fully locked in the detent 90. In other words, the handle and cam structures provide a positive stop in the open and closed orientation. The cam structures engage corresponding surfaces on the handle cam and the stator cam and tend to remain engaged to provide support or linkage in the open and closed positions. This provides a failsafe to some degree to prevent unintended disengagement of the stator from the tube 30 and rotor 24.

With further reference to FIG. 3, the stator 26 is retained at pivot point 63. It is about this pivot point 63 that the stator has some degree of rotory or pivoting motion. The level arm or handle 28 is movable about a fixed rotation axis 77 at the fixed end 76. This end is fixed such that it allows rotation about point 77. The rotor operates about a rotation point 100.

In a first plane 300 the level arm 28 has a fixed rotation axis 77 located distal from the privot point 63 of the stator 26. In this first plane 300 the fixed rotation axis 77 is also spaced from the rotation point 100 of the rotor. Generally, the rotation point 100 of the rotor is positioned keen the pivot point 63 in the fixed rotation axis 77. With reference a second plane, the fixed rotation axis 77 is also located distal from the pivot point 63. However, the pivot point 63 is located between the fixed rotation axis 77 and the rotation point 100 of the rotor. Description of these points in these two planes 300, 350 helps define the physical relationship in the mechanical interaction of these components.

The cam assembly is movable relative to the fixed rotation axis 77 generally in an area between the fixed rotation point fixed rotation axis 77 and both of the pivot point 63 and the rotation point 100. It can also be seen from FIG. 3 that in this embodiment the cam assembly is spaced generally distal from the pivot point 63 and relatively closer to the fixed rotation axis 77 and the rotation point 100.

Figure 4:
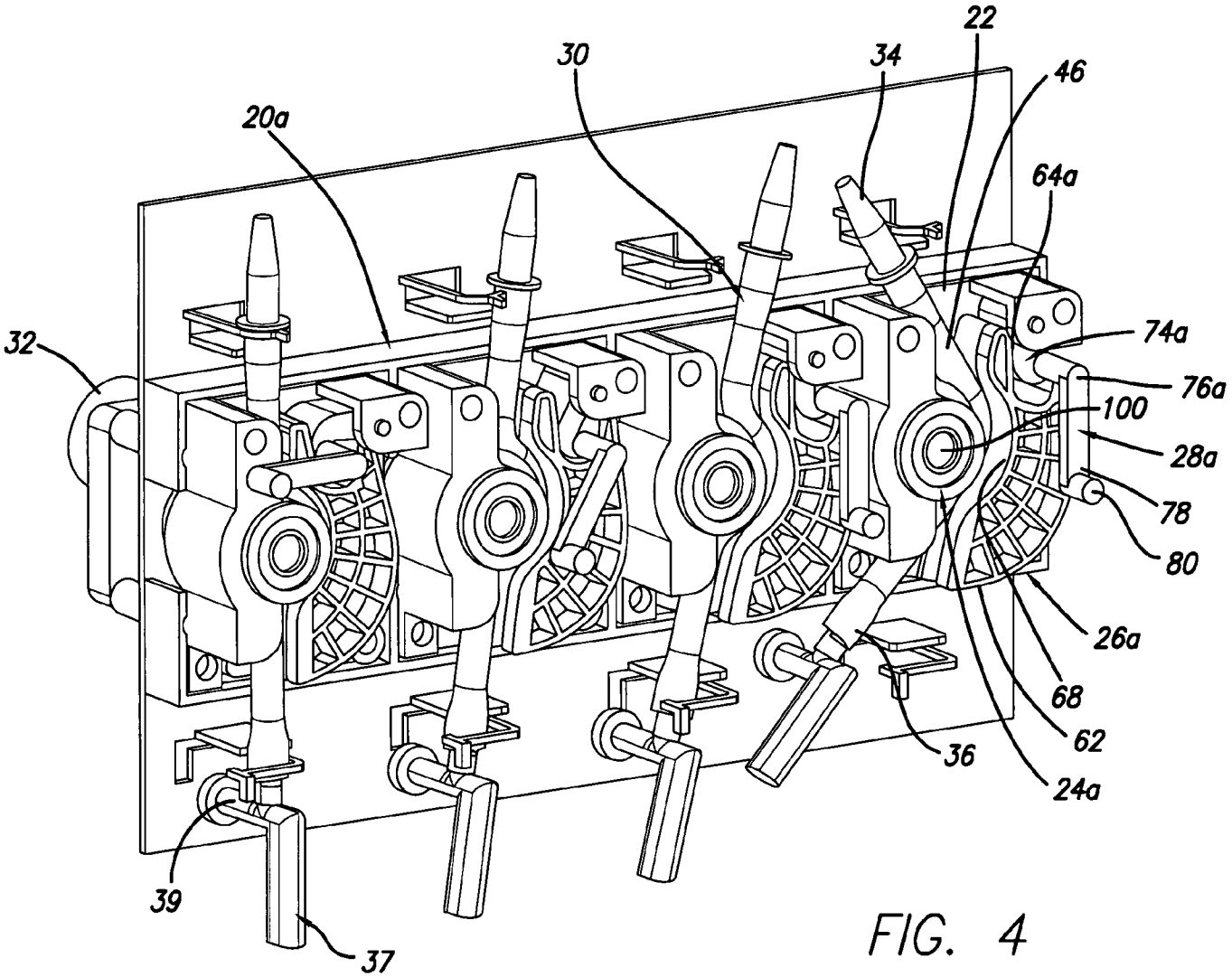
FIG. 4 is an alternate embodiment of the pump assembly including a movable stator for retaining a tube in engagement with a rotor and including a lever arm having a cam structure in which the cam structure acts against an upper portion of the stator.
Figure 5:
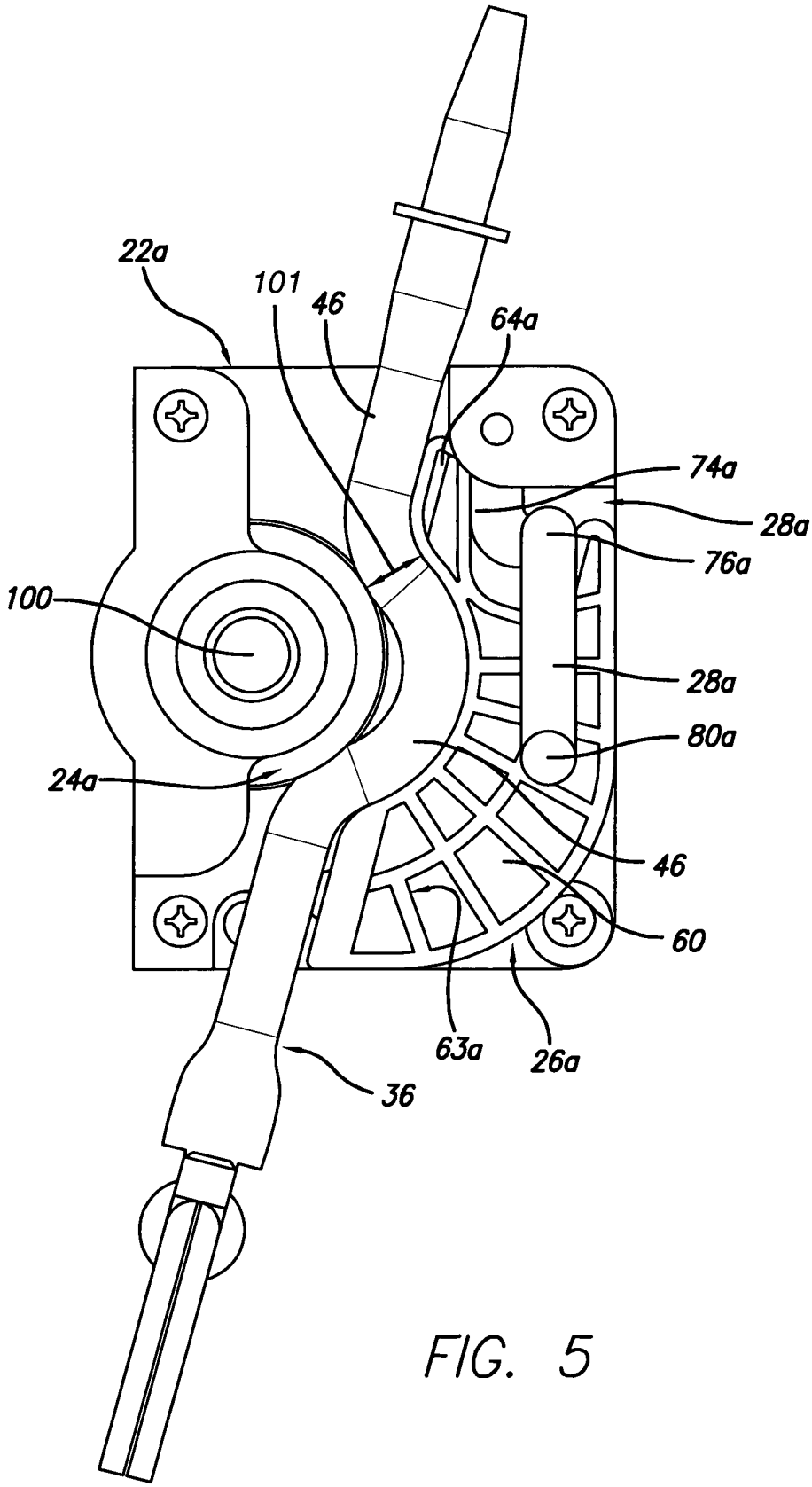
FIG. 5 is an enlarged progression generally showing the stator disengaged from the tube and rotor for positioning the tube between the stator and rotor with the lever arm in a disengaged position.

The foregoing description of the relationship between the components also applied to FIGS. 7-11. A slight variation applies to FIGS. 4-6. With reference to FIGS. 4-6, a pivot point 63*a* (see FIG. 5) is provided in a "lower portion" of the stator. The differences between these embodiments is generally only the orientation of the pivot point and not the function of these structures. In this regard, it is envisioned that all of the embodiments are consistent but that various orientations of these embodiments can be achieved. All embodiments and orientations of these structures are intended to be included within the scope of the present disclosure.

The rotor 24 and stator 26 are arranged on the body 22 and in orientation placing the pivot point 62 of the stator generally distal from a rotation point 100 of the rotor 24. This orientation helps to reduce the width of the pump assembly 20 to help facilitate placement of multiple pumps side by side in a smaller dimension. With the face 68 of the stator 26 was placed in direct opposition to the rotor 24, as might be found in some prior art devices, the pump assembly may require additional dimensional space. In the pump assembly as disclosed, the offset orientation also results in a moment arm 102 defined between the center of rotation 62 of the stator and the center of rotation or rotation point 100 of the rotor. This moment arm helps to increase the leverage associated with the stator impinging on the tube. As such, the orientation of the stator, rotor and corresponding surfaces help to make the overall assembly more compact as well as provide mechanical advantages in the operation of the pump.

It should be noted that the general structures and functions as defined throughout this application apply to the various embodiments as shown herein and should be expansively included with these embodiments. Specific variations among the embodiments will be identified in the corresponding description and/or discussion. Additional information will be apparent upon review of the associated drawings which may provide additional detail and illustration.

In use, the pump assembly 20 is positioned with the stator 26 in the position as shown in FIG. 1. In this regarding, the face 68 is disengaged from a position which might otherwise retain a tube between the face 68 and a corresponding portion of the rotor 24. In this disengaged position, the cam structure 74 of the cam assembly 64 is rotated clockwise on the handle 28 to drive the occlusion bed 26 away from the rotor 24 and generally pivot the body 60 counterclockwise about the pivot hub 62. In the position as shown in FIG. 1, the gap 101 is maximized to provide sufficient space for the insertion of a tube between the stator 26 and the rotor 24.

Once the tube is positioned as shown in FIG. 1, the handle 28 can be moved counterclockwise as shown in FIG. 2 to initiate movement of the stator 26 toward and against the pumping portion 46 of the tube 30. Movement of the handle 28 as shown in FIG. 2 drives the cam structure 74 against the corresponding cam surface 64 of the stator 26 to provide a mechanical advantage in positioning the stator 26 face against the tube 30. The extension of the handle and the cam arrangement helps to reduce the force needed to engage the tube with the pump. Any party installing a tube on a pump will be likely to do so without the need for an inordinate amount of strength, effort or force.

While the tube 30 has been positioned between the rotor and stator as shown in FIG. 1, urging of the stator against the tube and the tube against the rotor causes the tube to further deform, flex or otherwise bend around the curve of the rotor and form against and into the curve of the face 68.

With regard to the engaged progression as shown in FIG. 3, the tube 30 has been fully retained between the stator 26 and the rotor 24. The handle is positioned with the cam structure 74 locking against a corresponding cam portion 64 of the stator 26. The end 80 engages the detent 90 to retain the lever in the counterclockwise downward position.

From the perspective of a person operating or servicing the pump, the person removes a tube 30 from the pump 20 by lifting the lever (FIG. 3) in a clockwise direction to cause the cam structure 74 and cam surface 64 to operate to disengage the stator 26 from the tube 30 and the rotor 24. As the handle 28 is continued to be moved in the clockwise direction (see FIG. 2), the stator body 60 rotates counterclockwise about the pivot point 63 to move the face 68 out of engagement with the pumping portion of the tube 46. At the maximum extent of the movement of the handle 28 (see FIG. 1), a gap 101 is provided between the rotor 24 and the stator 26 to allow disengagement of the two from the pump 20. With the tube 30 removed from the pump a new tube can be placed in the gap 101. Prior to insertion of the new tube or prior tube, a cleaning product or cleaning device such as a sponge, rag, brush or other device may be moved between the rotor 24 and stator 26 to clean the area.

The operator visually observes placement and retention of the tube as the handle is moved (see FIG. 2) to retain the tube on the pump 20. The operator positions a handle in the down or locking position as shown in FIG. 3 to retain the engagement of the pump structures for proper functioning of the pump. The orientation of the pump structures may be advantageous in applications in which an operator needs to reach up to install the tube. In this regard, the operator will pull down on the handle to engage the bed 26 against the tube and rotor.

An additional embodiment of the pump of the present disclosure is provided in FIGS. 4-6. Generally, the additional embodiment includes the structures as shown in FIGS. 1-3 and as such similar or identical structures will be denoted by the same reference numerals with the addition of a suffix, for example, stator 26*a*. As shown in FIGS. 4-6 this embodiment of the pump 20*a* operates in a very similar fashion to that as described with regard to the embodiment as shown in FIGS. 1-3. One of the differences between the operation of the pumps is the location and orientation of the handle 28*a* relative to the stator 26*a* and the orientation of the pivot point 63*a* (see FIG. 5). In this regard, the stator 26*a* is retained at a pivot point 63*a* positioned at a lower most portion of the pump body 22*a*. In contrast, the embodiment as shown in FIGS. 1-3 positions the pivot point 63 at an upper most portion of the pump body 22. The stator 26 still pivots relative to the rotor to provide a gap between the face 68 and a corresponding portion of the rotor 24 for installing and removal of a tube. The handle provides a cam structure 76*a* to operate against a corresponding cam surface 64*a* on the stator 26*a*. The operation of the handle 28*s* against the stator 26*a* is consistent with that as described above with regard to FIGS. 1-3 with the exception that the handle rotates in the opposite direction when engaging and disengaging the stator 26*a* with the tube 30. While a lock or detent 90 as shown in FIGS. 1-3 is not shown in FIGS. 4-6 one could be provided in this design and is fully anticipated within the scope of this disclosure.

Further embodiments of the assembly are within the scope of the present disclosure. For example, the embodiment shown in FIGS. 7-11 is referred to herein. This embodiment includes the structures as shown in FIGS. 1-6 and as such similar or identical structures will be denoted by the same reference numerals with the addition of a suffix, for example, stator 26*b*.

With reference to FIG. 7, a wall 200 is provided. The rotor 24*b* is retainable on the body 22*b* and cooperates with the stator 26*b*. A handle 28*b* is provided to operate the stator 26*b* relative to the rotor 24*b*. A cover 38*b* is provided for attachment over the attachment to the body using fasteners 40*b*. The cover engages corresponding portions of the body 22*b* which provide additional reinforcement and strength to the assembly. The fasteners 40*b* attached to the body 22*b* to retain the cover in position while also providing an axis for providing an axel for the end of pivot 76 as well as the stator pivot point 63. As assembled, the pump assembly 20 can be attached to the wall 200. A wall can be formed of multiple positions for attachment of multiple pumps thereto. The wall provides structure for mounting the pumps as well as mounting connections or points.

In at least one embodiment, the pumps may be used in a refrigerated cabinet. The wall can be used to define a boundary between a refrigerated portion of the cabinet and an unrefrigerated portion. In this regard, the pumps can be mounted on the refrigerated side of the cabinet to help retain the product in the tube of the pump in a, chilled and fresher condition. Additionally, should a tube break or otherwise some form of contamination enter the pumping area, the wall will prevent the material from getting on the motor. In this regard, the pump can be removed quickly and easily by removing several quick release fasteners 202 to remove the pump assembly, clean the area on the wall, and replace the pump assembly. To further facilitate efficient cleaning of the system, the fasteners 40*b* can be replaced by quick release devices which do not require tools for removal and facilitate easy disengagement of the components, so that the components can be removed and cleaned.

Figure 8:
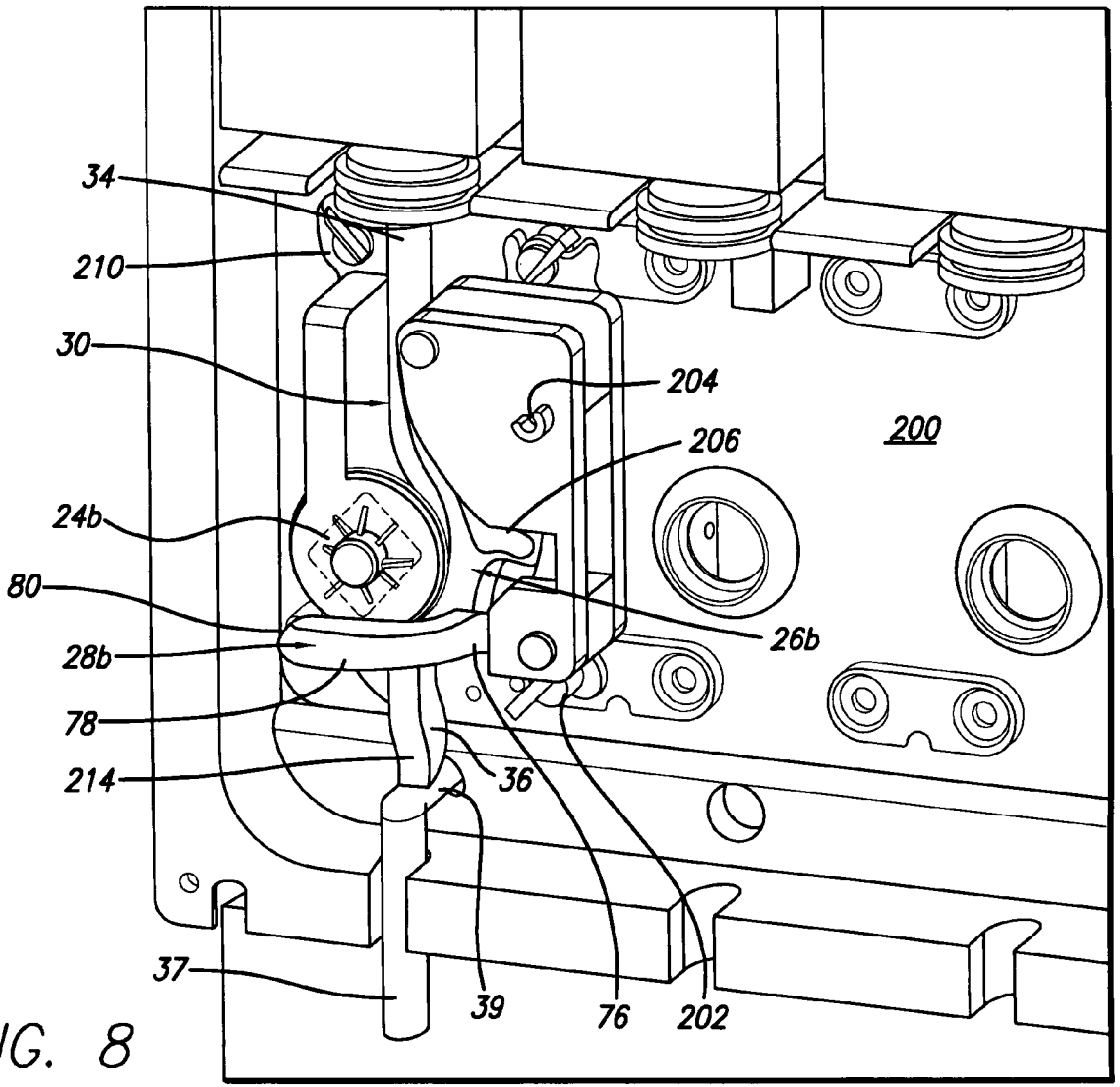
FIG. 8 an enlarged perspective view of a pump assembly attached to the wall with quick release fastening devices.
Figure 9:
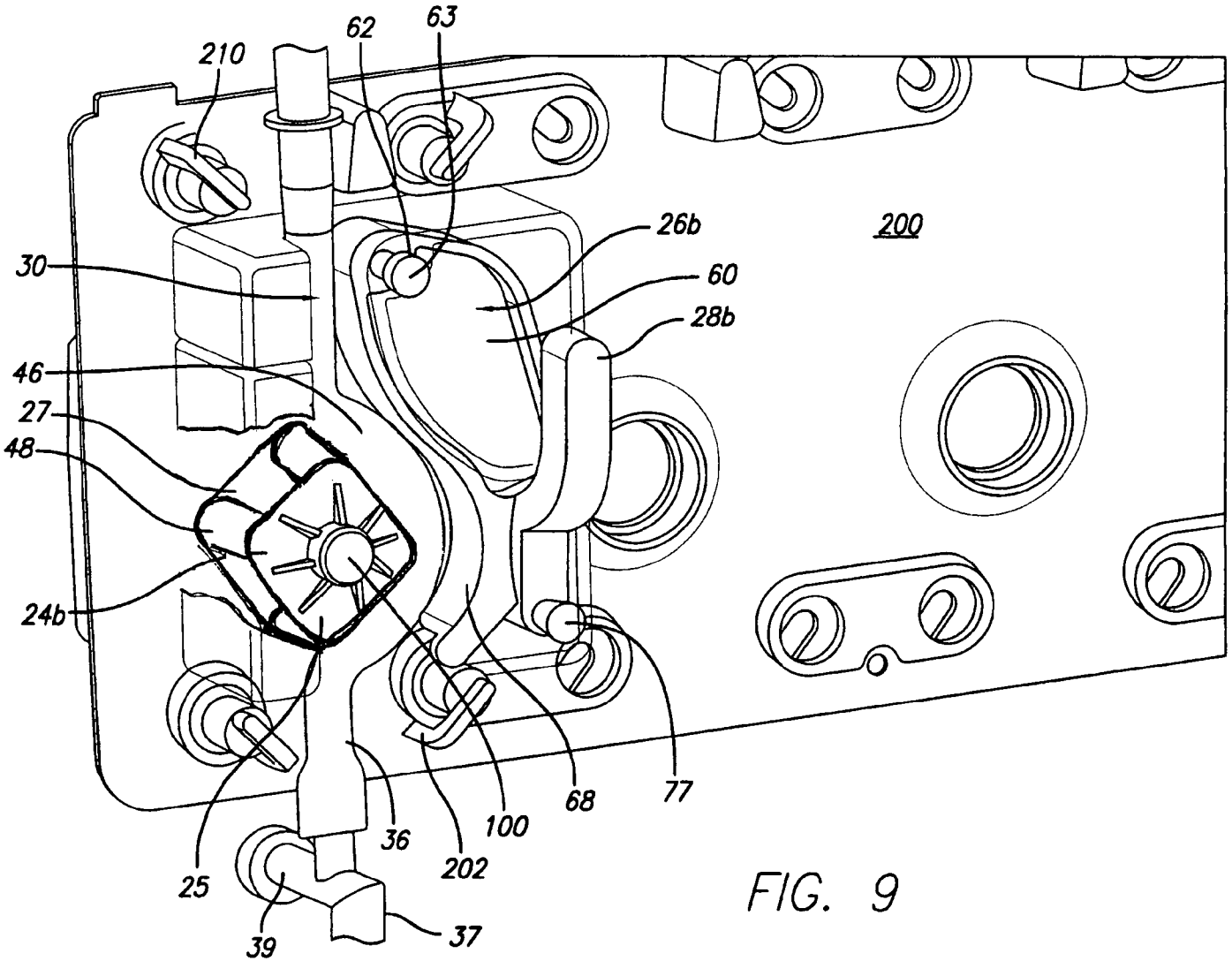
FIG. 9 the enlarged perspective view of FIG. 8 viewed for the other side of the pump assembly in which the stator is spaced from the rotor for insertion or removal of the tube from the pump, with the lever arm in a raised position, in this view a housing portion of the pump assembly has been removed to show more clearly the relationship between the rotor, stator, tube and lever arm.
Figure 10:
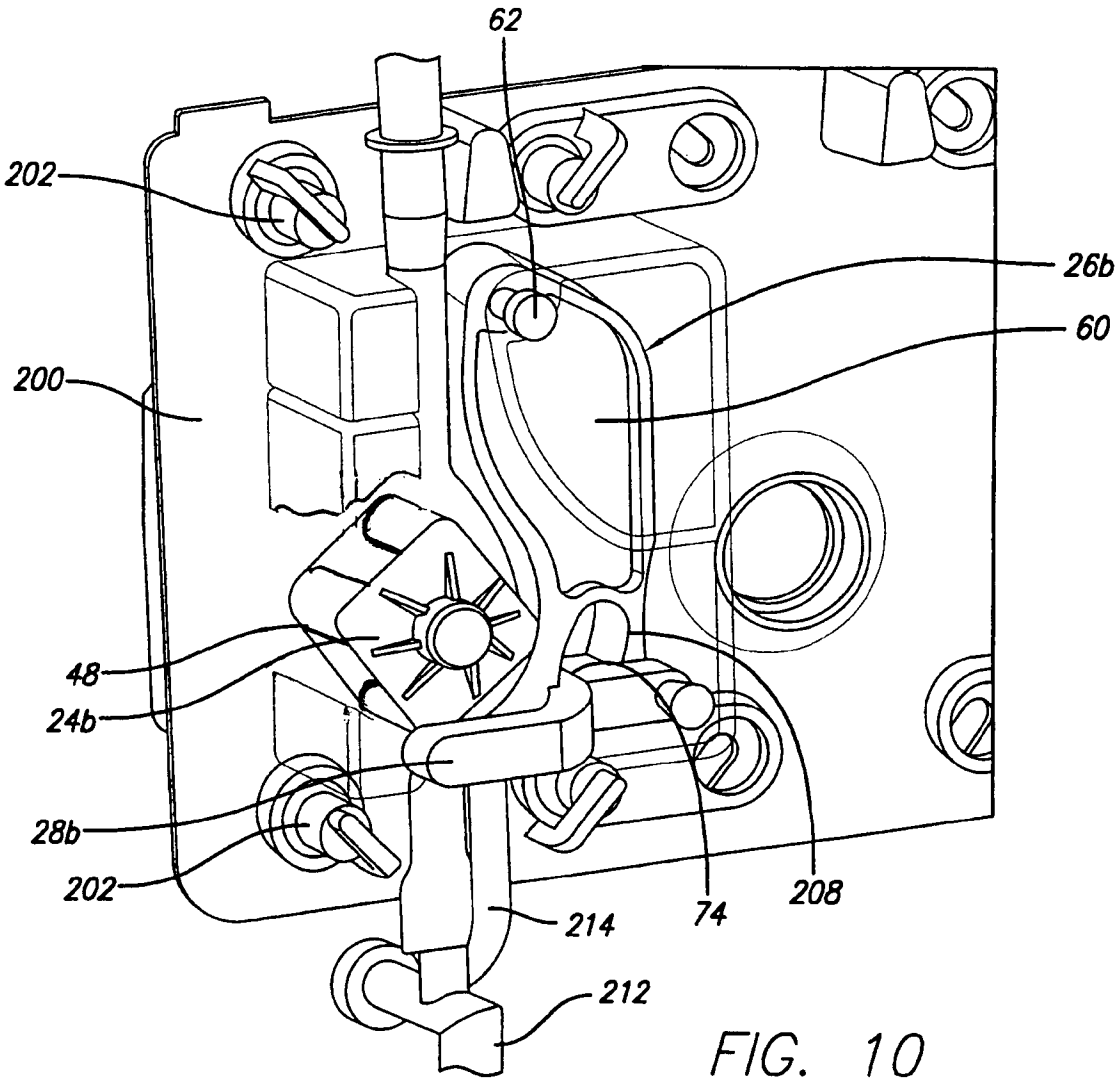
FIG. 10 is a view of the pump similar to the view in FIG. 9 in which the stator has been position for engaging the tube against the rotor, with the lever arm in the down or closed position and with a tube cover positioned in front of the tube connection to the nozzle for protecting the connection and providing a properly locked indicator.
Figure 11:
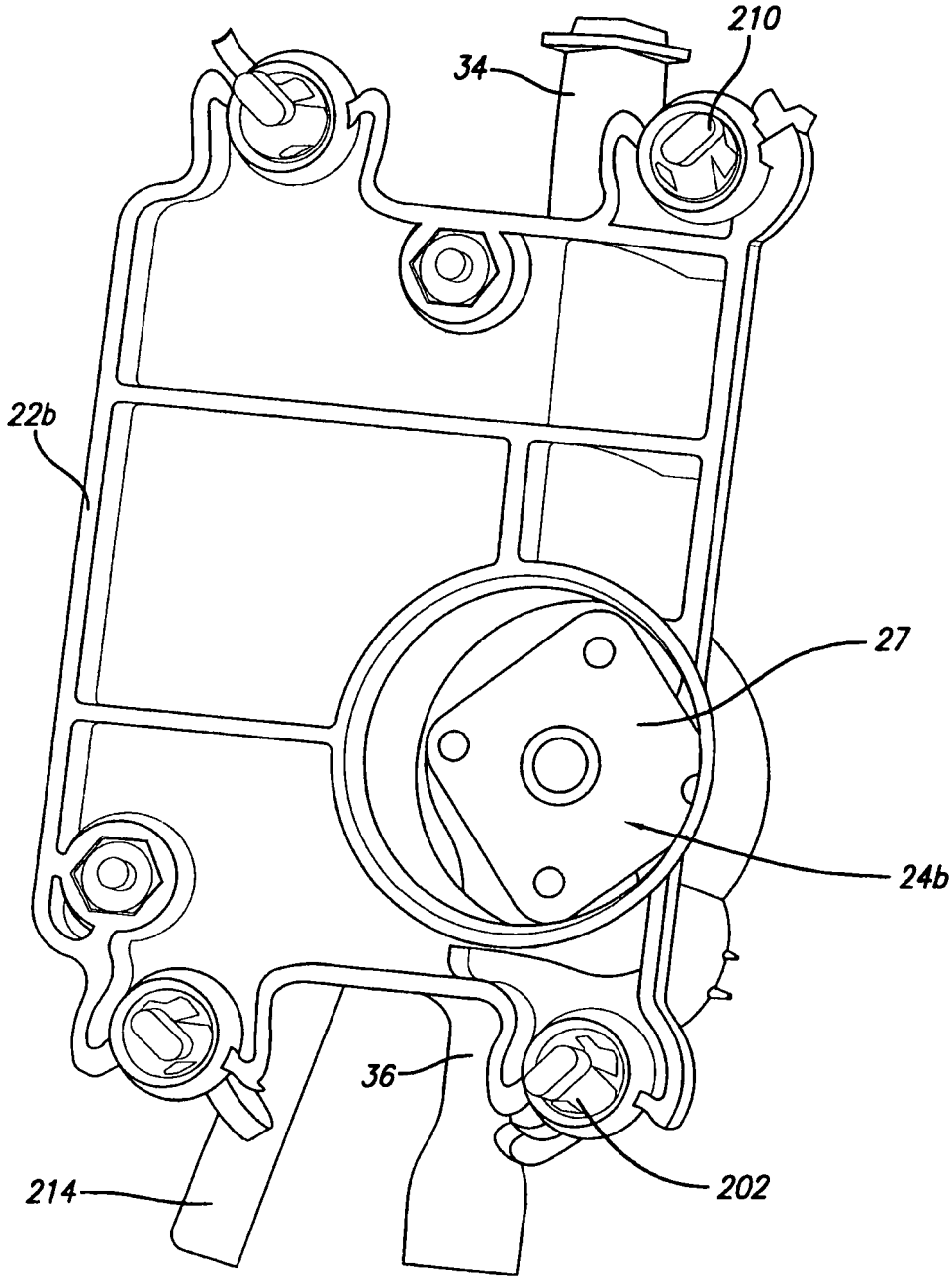
FIG. 11 is a rear side view of the pump assembly shown in FIGS. 7-10 showing the surfaces and structures abutting or attached to the wall.

The pump is shown in FIGS. 8-10 with the reverse side of the pump being shown in FIG. 11. The pump shown includes the rotor 24*b* and stator 26*b*. Shown in FIG. 8, the handle engages a positive stop in the locking or engaging position and a positive stop 204 in the open or disengaged positions. The cover 38*b* includes a notch 206 to allow movement of the handle during the opening and closing steps. As shown in FIGS. 9 and 10, the cover is removed in the interest of reviewing the components under the cover. As shown in FIGS. 8-10 the handle cam 74 is positively retained in the stator cam 76. The stator cam structure includes a rear side 208 which limits movement of the stator in the open direction.

The operation of the rotor, tube, stator, handle and related components, structures and functions generally function as disclosed with regard to the additional embodiments. Quick release fasteners 202 are provided to attach the body to the wall 200. The quick release fasteners may be of the form which include a 90 degree or 45 degree twist to engage the fastener with the wall. The fastener inserts through the fastener host on the body 22*b* of the pump, extends through the post to 10 and into the wall. This allows for quick and efficient removal of the pump assembly from the wall. As shown in the drawings, a nozzle 212 is attached to an output end 36 of the tube 30. A tube end nozzle fitment cover 214 over extends from the can over the connection portion of the tube 230 to the nozzle 212. This provides a flag to indicate that the tube is connected to the nozzle and that all the components are properly in place for pumping action.

FIG. 11 shows the rear side of the pump assembly and the portion of the body 22*b* which faces and abuts the wall 200. The body 22*b* is a generally plainer closed structure that prevents any material which might accumulate on the pumping side (with the rotor 24 and stator 26) from interfering with the operation of the motor. The pump assembly can be sold or otherwise provided as a unit which can be attached to the wall 200. The pump components can be disassembled from the pump assembly to accommodate different tube characteristics such as diameter, compressibility, and flow characteristics. Alternatively, a pump may be provided to accommodate these features without disassembly of the pump structure such that the modular pump assembly can merely be removed from and a new pump assembly replaced on the wall 200.

While this disclosure has been described as having an exemplary embodiment, this application is intended to cover any variations, uses, or adaptations using its general principles. It is envisioned that those skilled in the art may devise various modifications and equivalents without departing from the spirit and scope of the disclosure as recited in the following claims. Further, this application is intended to cover such departures from the present disclosure as may come within the known or customary practice within the art to which it pertains.

The invention claimed is:

1. A pump assembly for use in pumping a viscous material through a pumping tube which can be engage by the pump assembly, the pump assembly comprising;

a pump body;

a rotor rotatably retained on the pump body; the rotor having a pair of plates for operatively retaining a plurality of rollers therebetween, the plates having generally rectangular shape and having rounded corners extending sufficiently to generally cover ends of the corresponding rollers retained between the plates and to support the rollers;

a stator pivotably retained on the pump body;

a lever arm operatively retained on the pump body;

a cam assembly associated with the lever arm and the stator for use in engaging the stator to move the stator to an engaged position engaging a pumping tube between the rotor and the stator, and for use in disengaging the pumping tube from between the rotor and the stator; and the stator being pivotably retained on the pump body at a single pivot point and pivoting at that pivot point spaced from a rotation point of the rotor, the lever arm being movable relative to a fixed rotation axis on the pump body and spaced from the pivot point and the rotation point for engaging and disengaging the stator, the lever arm including a portion extending over a portion of the tube engaged between the stator and rotor in the engaged position.

2. The pump assembly of claim 1, further comprising the stator being pivotably retained on an upper portion of the pump body.

3. The pump assembly of claim 2, further comprising the cam assembly being movable relative to the fixed rotation axis and generally between the pivot point and the fixed rotation axis.

4. The pump assembly of claim 1, wherein in a first plane defined relative to the pump body the lever arm fixed rotation axis is located distal from pivot point of stator and the rotation point of rotor is positioned between the pivot point and the fixed rotation axis.

5. The pump assembly of claim 4, further comprising the cam assembly being movable relative to the fixed rotation axis and generally in an area between the fixed rotation axis and both of the pivot point and the rotation point.

6. The pump assembly of claim 4, further comprising the cam assembly movable relative to the to the fixed rotation axis and spaced distal from the pivot point and positioned generally closer to the fixed rotation axis than the pivot point.

7. The pump assembly of claim 2, wherein in a second plane defined relative to the pump body the lever arm fixed rotation axis is located distal from the pivot point of the stator and the pivot point of the stator is positioned between the rotation point and the fixed rotation axis.

8. The pump assembly of claim 7, further comprising the cam assembly being movable relative to the fixed rotation axis and generally in an area between the fixed rotation axis and both the pivot point and the rotation point.

9. The pump assembly of claim 7, further comprising the cam assembly movable relative to the to the fixed rotation axis and spaced distal from the pivot point and positioned generally closer to the fixed rotation axis than the pivot point.

10. The pump assembly of claim 1, further comprising the stator being pivotably retained on an upper portion of the pump body;

in a first plane defined relative to the pump body the lever arm fixed rotation axis is located distal from pivot point of the stator and the rotation point of rotor is positioned between the pivot point and the fixed rotation axis, and in a second plane defined relative to the pump body the lever arm fixed rotation axis is located distal from the pivot point of the stator and the pivot point of the stator is positioned between the rotation point and the fixed rotation axis.

11. The pump assembly of claim 10, further comprising the cam assembly being movable relative to the fixed rotation axis and generally in an area between the fixed rotation axis and both of the pivot point and the rotation point.

12. The pump assembly of claim 10, further comprising the cam assembly movable relative to the to the fixed rotation axis and spaced distal from the pivot point and positioned generally closer to the fixed rotation axis than the pivot point.

13. The pump assembly of claim 10, further comprising the cam assembly movable relative to the to the fixed rotation axis and generally between the pivot point and the fixed rotation axis.

14. The pump assembly of claim 1, further comprising the stator being pivotably retained on a lower portion of the pump body;

in a first plane defined relative to the pump body the lever arm fixed rotation axis is located distal from pivot point of stator and the rotation point of rotor is positioned between the pivot point and the fixed rotation axis, and in a second plane defined relative to the pump body the lever arm fixed rotation axis is located distal from the pivot point of the stator and the pivot point of the stator is positioned generally between the rotation point and the fixed rotation axis.

15. The pump assembly of claim 1, further comprising a detent on the assembly for receiving and retaining the lever arm in a closed position when the lever arm is rotated to engage the stator towards the rotor.

16. The pump assembly of claim 1, further comprising captive retaining fasteners carried on pump body for engagement with a housing to which the pump assembly is attached for use.

17. A beverage dispenser including at least one modular pump assembly for use in pumping a viscous material through a pumping tube which can be engage by the pump assembly, the modular pump assembly comprising;

a pump body retained in the beverage dispenser;

a rotor rotatably retained on the pump body; the rotor having a pair of plates for operatively retaining a plurality of rollers therebetween, the plates having generally rectangular shape and having rounded corners extending sufficiently to generally cover ends of the corresponding rollers retained between the plates and to support the rollers;

a stator pivotably retained on the pump body;

a lever arm operatively retained on the pump body;

the pumping tube extending from a beverage material source, the pumping tube extending in a compressible condition between opposing portions of the stator and rotor;

a cam assembly associated with the lever arm and the stator for use in engaging the stator to move the stator to engage the pumping tube between the rotor and the stator, and for use in disengaging the pumping tube from between the rotor and the stator; and the stator being operatively retained on the pump body at a single pivot point and pivoting at that pivot point spaced from a rotation point of the rotor, the lever arm being movable relative to a fixed rotation axis and spaced from the pivot point and the rotation point for engaging and disengaging the stator, the lever arm including a pivot end and a distal end with the distal end having a protrusion engaging a stop when the pumping tube is engaged between the rotor and the stator.

18. A pump assembly for use in pumping a viscous material through a pumping tube which can be engage by the pump assembly, the pump assembly comprising;

a pump body;

a rotor rotatably retained on the pump body; the rotor having a plurality of rollers;

a stator pivotably retained on the pump body; the stator and rollers defining a path for a pumping portion of the tube;

a lever arm operatively retained on the pump body;

a cam assembly associated with the lever arm and the stator for use in engaging the stator to move the stator to engage the pumping tube between the rotor and the stator in an engaged position, and for use in disengaging the pumping tube from between the rotor and the stator to achieve a disengaged position, the lever arm extending adjacent but not across the tube in the disengaged position and the lever arm extending across the tube in the engaged position;

the stator being operatively retained on an upper portion of the pump body at a single pivot point and pivoting generally downwardly at that pivot point spaced from a rotation point of the rotor, the lever arm being movable relative to a fixed rotation axis and spaced from the pivot point and the rotation point for engaging and disengaging the stator;

in a first plane the lever arm fixed rotation axis and the pivot point of the stator are located on one side of the path and the rotation point of the rotor is positioned on one an opposite side of the path;

a cam assembly movable relative to the fixed rotation axis and generally in an area between the fixed rotation axis and both of the pivot point and the rotation point, and the cam assembly movable relative to the to the fixed rotation axis and spaced distal from the pivot point and generally closer to the fixed rotation axis than the pivot point.

19. The pump assembly of claim 1 wherein the handle is operable to retain the stator out of engagement with the tube.

20. The pump assembly of claim 1 wherein the handle and cam structures provide an over center positive stop when the tube is engaged between the stator and rotor.

21. The pump assembly of claim 1 wherein the handle and cam structures provide an over center positive stop when the tube is disengaged from the stator and rotor.

* * * * *